US009563158B2

(12) United States Patent
Tress

(10) Patent No.: US 9,563,158 B2
(45) Date of Patent: Feb. 7, 2017

(54) TAP FOR A SOLID RESISTIVE HEATER ELEMENT

(71) Applicant: Xerox Corporation, Norwalk, CT (US)

(72) Inventor: Tab Alan Tress, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 15 days.

(21) Appl. No.: 14/522,671

(22) Filed: Oct. 24, 2014

(65) Prior Publication Data

US 2016/0116872 A1 Apr. 28, 2016

(51) Int. Cl.
*G03G 15/20* (2006.01)
*H05B 1/02* (2006.01)

(52) U.S. Cl.
CPC ..... *G03G 15/2053* (2013.01); *H05B 1/0241* (2013.01)

(58) Field of Classification Search
CPC ..... G03G 15/2053; H05B 1/0241
See application file for complete search history.

(56) References Cited

U.S. PATENT DOCUMENTS

| | | | | |
|---|---|---|---|---|
| 6,336,009 | B1 | 1/2002 | Suzumi et al. | |
| 6,734,397 | B2 | 5/2004 | Kato et al. | |
| 6,870,140 | B2 | 3/2005 | Cook et al. | |
| 7,228,082 | B1 | 6/2007 | Davidson et al. | |
| 7,587,162 | B2 | 9/2009 | Davidson et al. | |
| 7,623,819 | B2 | 11/2009 | Tress | |
| 8,669,495 | B2 | 3/2014 | Makihira et al. | |
| 2004/0245236 | A1 | 12/2004 | Cook et al. | |
| 2012/0051807 | A1* | 3/2012 | Tress | G03G 15/2053 399/328 |

* cited by examiner

*Primary Examiner* — David Gray
*Assistant Examiner* — Michael Harrison
(74) *Attorney, Agent, or Firm* — Gibb & Riley, LLC

(57) ABSTRACT

Devices and methods to enable a fuser heater within a printing device. The heater includes conductive traces and a resistive trace having a first end and a second end. The resistive trace is connected to the conductive traces at each of the first end and the second end and forms an electrical connection between the conductive traces and the resistive trace. The resistive trace further includes a tap between the first end and the second end, connecting the resistive trace to one of the conductive traces and forming an electrical connection between the one of the conductive traces and the resistive trace. The tap comprises multiple branches extending out of the resistive trace. A gap is formed between each of the branches.

20 Claims, 3 Drawing Sheets

TAP FOR A SOLID RESISTIVE HEATER ELEMENT

BACKGROUND

Devices and methods herein generally relate to machines such as printers and/or copier devices and, more particularly, to heater elements in the device.

In electrostatographic printing, commonly known as xerographic or printing or copying, a process step is known as "fusing". In the fusing step of the xerographic process, dry marking making material, such as toner, that has been placed in imagewise fashion on an imaging substrate, such as a sheet of paper, is subjected to heat and/or pressure in order to melt, or otherwise fuse the toner permanently on the substrate. In this way, durable, non-smudging images are rendered on the substrate.

SUMMARY

According to a fuser heater within a printing device, the heater comprises conductive traces and a resistive trace having a first end and a second end. The resistive trace is connected to the conductive traces at each of the first end and the second end and forms an electrical connection between the conductive traces and the resistive trace. The resistive trace further comprises a tap between the first end and the second end, connecting the resistive trace to one of the conductive traces and forming an electrical connection between the one of the conductive traces and the resistive trace. The tap comprises multiple branches extending out of the resistive trace. A gap is formed between each of the branches.

According to a machine herein, the machine comprises an imaging apparatus recording an image, a transfer device transferring the image onto a copy sheet, and a fuser. The fuser comprises a fuser roll and a pressure roll. The fuser roll and pressure roll form a nip therebetween through which the copy sheet is conveyed, fusing the image onto the copy sheet. The fuser roll includes a heater comprising a conductive trace and a resistive trace. The resistive trace has a tap connecting the resistive trace to the conductive trace and forms an electrical connection between the conductive trace and the resistive trace. The tap comprises multiple branches extending out of the resistive trace. A gap is formed between each of the branches.

According to a printer herein, an imaging apparatus records an image. A transfer device transfers the image onto a copy sheet. The printer includes a fuser comprising a fuser roll and a pressure roll. The fuser roll and pressure roll form a nip therebetween through which the copy sheet is conveyed, fusing the image onto the copy sheet. The fuser roll includes a heater comprising a single main resistive trace having a first end and a second end. The single main resistive trace is contacted at multiple points by conductive traces segmenting the main trace into multiple segments. These resistive trace contact points, being referred to as taps, between the first end and the second end form an electrical connection to the main single resistive trace. The tap comprises branches extending out of the single main resistive trace. A gap is formed between each of the branches.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
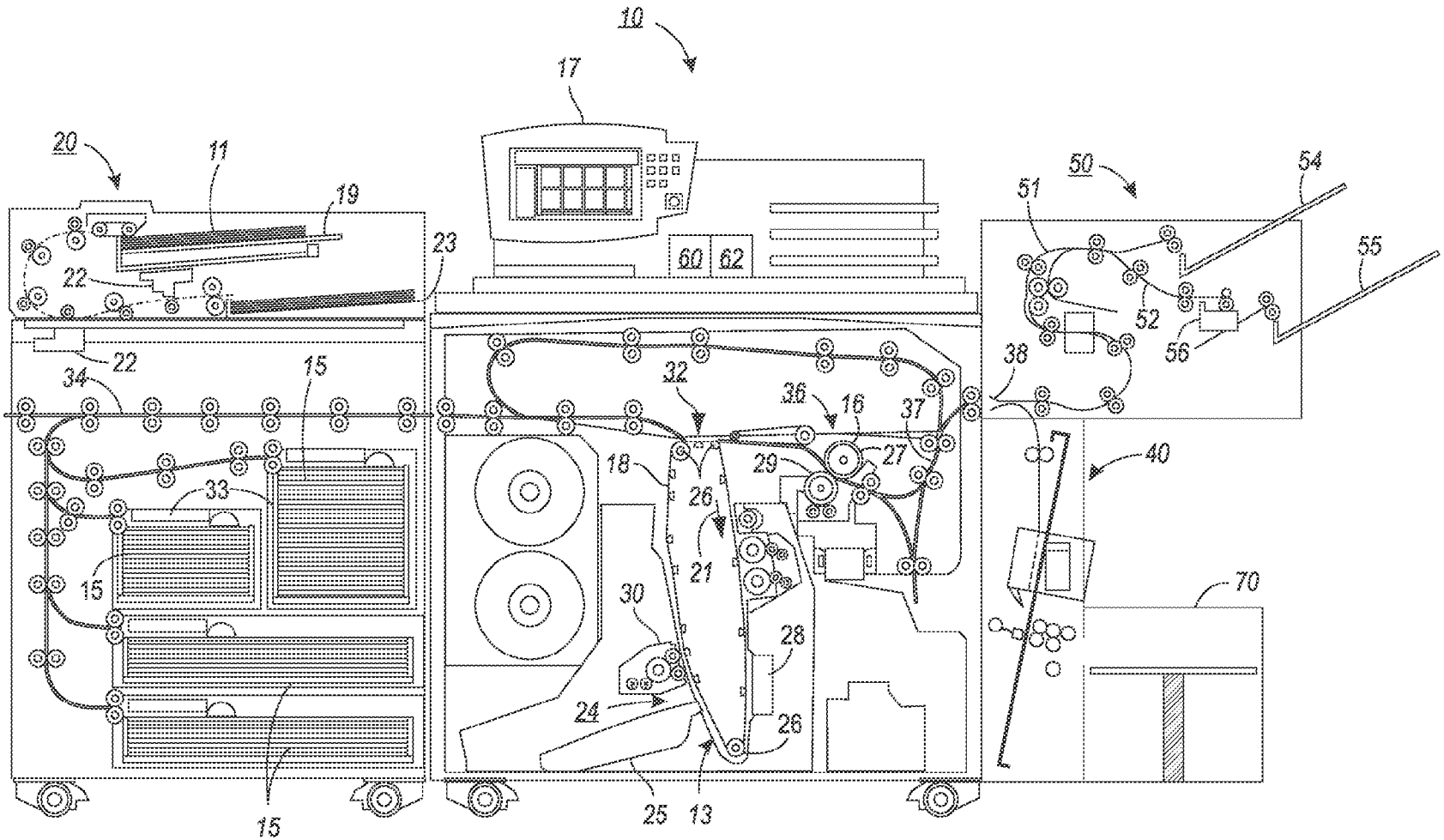
FIG. 1 is a side-view schematic diagram of a printing device according to devices and methods herein.

The disclosure will now be described by reference to a printing apparatus that includes a device and method for providing a fuser heater in a printing device. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

The term 'printer', 'printing device', or 'reproduction apparatus' as used herein broadly encompasses various printers, copiers, or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

Referring to the FIG. 1, a printing device 10 is shown which can be used with devices and methods herein and can comprise, for example, a printer, copier, multi-function machine, multi-function device (MFD), etc. The printing device 10 includes an automatic document feeder 20 (ADF) that can be used to scan (at a scanning station 22) original documents 11 fed from a first tray 19 to a second tray 23. The user may enter the desired printing and finishing instructions through the graphic user interface (GUI) or control panel 17, or use a job ticket, an electronic print job description from a remote source, etc. The GUI or control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The photoreceptor belt 18 is mounted on a set of rollers 26. At least one of the rollers 26 is driven to move the photoreceptor belt 18 in the direction indicated by arrow 21 past the various other known electrostatic processing stations, including a charging station 28, imaging station 24 (for a raster scan laser system 25), developing station 30, and transfer station 32.

Thus, the latent image is developed with developing material to form a toner image corresponding to the latent image. More specifically, a sheet of print media 15 is fed from a selected media sheet tray 33 having a supply of paper to a sheet transport 34 for travel to the transfer station 32. There, the toned image is electrostatically transferred to the print media 15, to which it may be permanently fixed by a fusing apparatus 16. The sheet is stripped from the photoreceptor belt 18 and conveyed to a fusing station 36 having fusing apparatus 16 where the toner image is fused to the sheet. The fusing apparatus 16 includes a fuser roll 27 and pressure roll 29. Typically, in this design, the fusing member (fuser roll 27) comprises a very thin tube and is normally referred to as a belt, due to its flexibility. A guide can be applied to the print media 15 to lead it away from the fuser roll 27. After separating from the fuser roll 27, the print media 15 is then transported by a sheet output transport 37 to output trays in a multi-functional finishing station 50.

Printed sheets from the printing device 10 can be accepted at an entry port 38 and directed to multiple paths and output trays for printed sheets, top tray 54 and main tray 55, corresponding to different desired actions, such as stapling, hole-punching and C or Z-folding. The multi-functional finishing station 50 can also optionally include, for example, a modular booklet maker 40 although those ordinarily skilled in the art would understand that the multi-functional finishing station 50 could comprise any functional unit, and that the modular booklet maker 40 is merely shown as one example. The finished booklets are collected in a stacker 70. It is to be understood that various rollers and other devices that contact and handle sheets within the multi-functional finishing station 50 are driven by various motors, solenoids, and other electromechanical devices (not shown), under a control system, such as including the processor 60 of the GUI or control panel 17 or elsewhere, in a manner generally familiar in the art. The processor 60 may comprise a microprocessor.

Thus, the multi-functional finishing station 50 has a top tray 54 and a main tray 55 and a folding and booklet making station that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through staplers 56 and is used for most jobs that require stacking or stapling. The folding destination is used to produce signature booklets, saddle stitched or not, and tri-folded. The finished booklets are collected in a stacker 70. Sheets that are not to be C-folded, Z-folded, or made into booklets or that do not require stapling are forwarded along path 51 to top tray 54. Sheets that require stapling are forwarded along path 52, stapled with staplers 56, and deposited into the main tray 55.

As would be understood by those ordinarily skilled in the art, the printing device 10 shown in FIG. 1 is only one example, and the devices and methods herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with devices and methods herein.

Currently, the most common design of a fusing apparatus 16 as used in commercial xerographic printers includes two rolls, typically called a fuser roll 27 and a pressure roll 29, forming a nip therebetween for the passage of the sheet therethrough. The nip has an entrance side through which the sheet of print media 15 enters. The sheet of print media 15 comes out of the exit side of the nip and is then transported by the sheet output transport 37. Typically, the fuser roll 27 further includes one or more heating elements, which radiate heat in response to a current being passed therethrough. The heat from the heating elements passes through the surface of the fuser roll 27, which in turn contacts the side of the sheet having the image to be fused, so that a combination of heat and pressure successfully fuses the image.

In more sophisticated designs of a fusing apparatus 16, provisions can be made to take into account the fact that sheets of different sizes may be passed through the fusing apparatus 16, ranging from postcard-sized sheets to sheets that extend the full length of the rolls. These designs provide for controlling the heating element or elements to take into account the fact that a sheet of a particular size of paper is fed through the nip.

The fusing apparatus 16 may include a plurality of predefined sized fusing areas that are selectively activatable and the plurality of predefined sized fusing areas are arranged in a substantially parallel manner along a process direction of the fusing apparatus 16. A controller is included for activating one or more of the plurality of predefined sized fusing areas to correspond to one of the selected predefined sized sheets.

The use of multiple resistive trace designs allows for simple manufacturing, but performance is impacted due to the positioning of the resistive traces relative to the nip geometry. Optimized performance occurs when the resistive trace is positioned at the nip centerline with an offset towards the entrance side of the nip. This can only be fully accomplished with a single resistive trace heating design, but requires taps to allow for changing the heating width of the device in order to support various paper sizes. The devices and methods described herein provides for a means to implement a center tap without the impact of gross resistive changes, leading to cold spots while the tap is not being used.

Figure 2A:
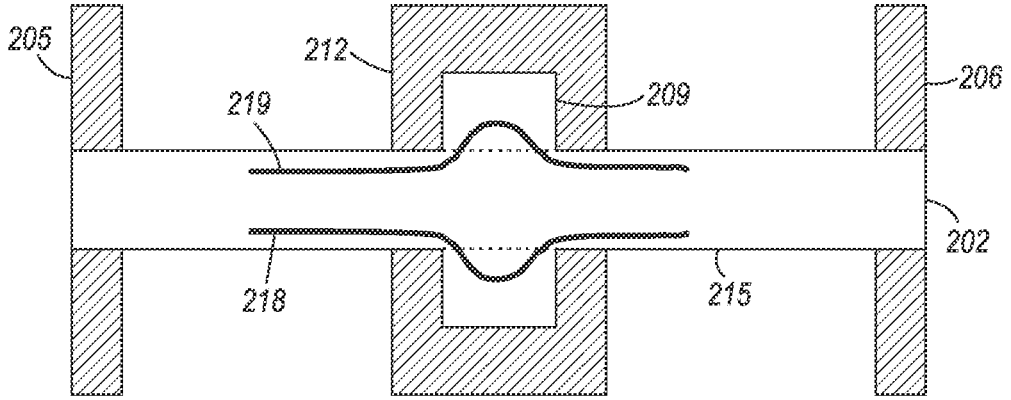
FIG. 2A is an illustration of a resistive trace.

FIG. 2A shows a resistive trace 202 connected to conductive traces 205, 206 at each end. The resistive trace 202 may also include a tap 209 connected to a conductive trace 212 in the middle of the resistive trace 202. As shown in FIG. 2A, tap 209 is a solid tap. More than one tap 209 may be included. When a relatively small sheet is passed through the nip of the fusing apparatus, only a portion of the resistive trace 202, such as indicated at 215, is necessary. Electrical current flows between, for example, conductive trace 206 and conductive trace 212 ensures the heat from the resistive trace 202 is radiated only along the portion 215 corresponding to the sheet size, thereby aiding in the prevention of the fusing apparatus and the xerographic system as a whole from overheating. The heat is evenly distributed along the portion 215 of the resistive trace 202 between conductive trace 206 and conductive trace 212.

Multi-tap series controlled heaters of this design have a flaw in that the interface of tap 209 to the heat-producing resistive trace 202 creates a cold spot that reduces the temperature locally and creates a radial cold area in the fuser roll causing image quality issues. For example, when a large sheet of paper is passed through the nip, electrical current flows between conductive traces 205, 206 in order to utilize the entire resistive trace 202 (i.e., the tap 209 is bypassed). The resistance of the resistive trace 202 is relatively lower in the vicinity of the tap 209, due to the wider cross-conductive area. Therefore, with less resistance, the electrical current through the resistive trace 202 changes, as shown by lines 218, 219. Accordingly, the temperature of the resistive trace 202 drops in the vicinity of the tap 209.

Figure 2B:
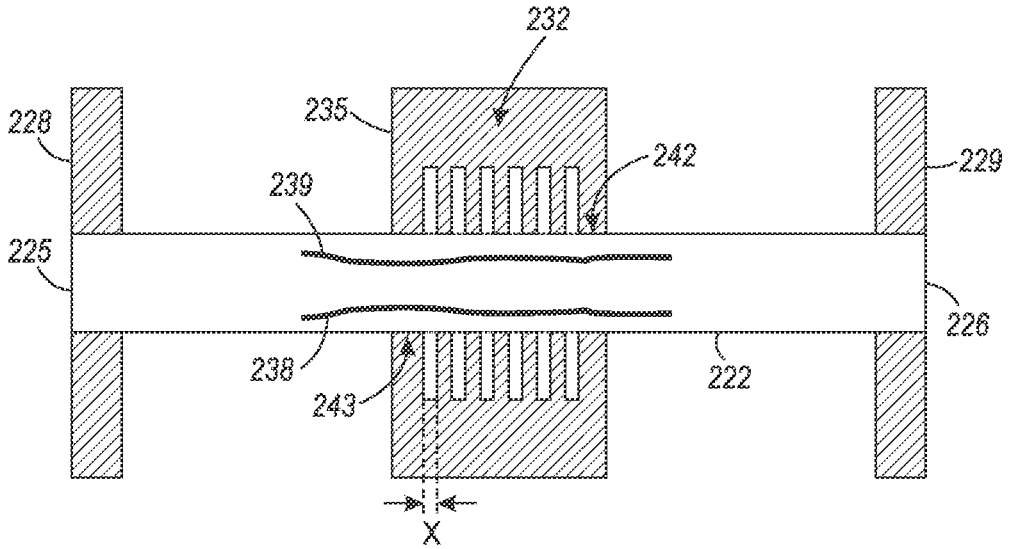
FIG. 2B is an illustration of a resistive trace according to devices and methods herein.

FIG. 2B shows a resistive trace 222, according to devices and methods herein. The resistive trace 222 has a first end 225 and a second end 226. The resistive trace 222 is connected to conductive traces 228, 229 at the first end 225 and second end 226, respectively. An electrical connection is formed between the conductive traces 228, 229 and the resistive trace 222 at each end. According to devices and methods herein, the resistive trace 222 also includes a multi-branched tap 232 connected to a conductive trace 235 between the first end 225 and second end 226 of the resistive trace 222. More than one multi-branched tap 232 may be included.

Each branch of the multi-branched tap 232 may have a width of approximately X with a gap between each branch of approximately X. The gaps between the branches do not need to equal X, and need not be uniform across the multi-branched tap 232. In this configuration, the resistance of the resistive trace 222 remains relatively constant in the vicinity of the multi-branched tap 232. Therefore, when the multi-branched tap 232 is bypassed (e.g., when a large sheet of paper is passed through the nip), the electrical current through the resistive trace 222 remains relatively uniform, as shown by lines 238, 239. Accordingly, the thermal profile of the resistive trace 222 remains relatively uniform in the vicinity of the multi-branched tap 232.

The connection from the multi-branched tap 232 to the conductive trace 235 may be formed on a single mask along with the conductive traces 228, 229. It is contemplated that the connection from the multi-branched tap 232 may be intercalated with the conductive trace 235. According to devices and methods herein, the conductive trace 235 may overlap the outer lateral boundaries of the multi-branched tap 232, such as indicated generally as 242, 243, by at least half the width of the branches (i.e., X/2).

Figure 3:
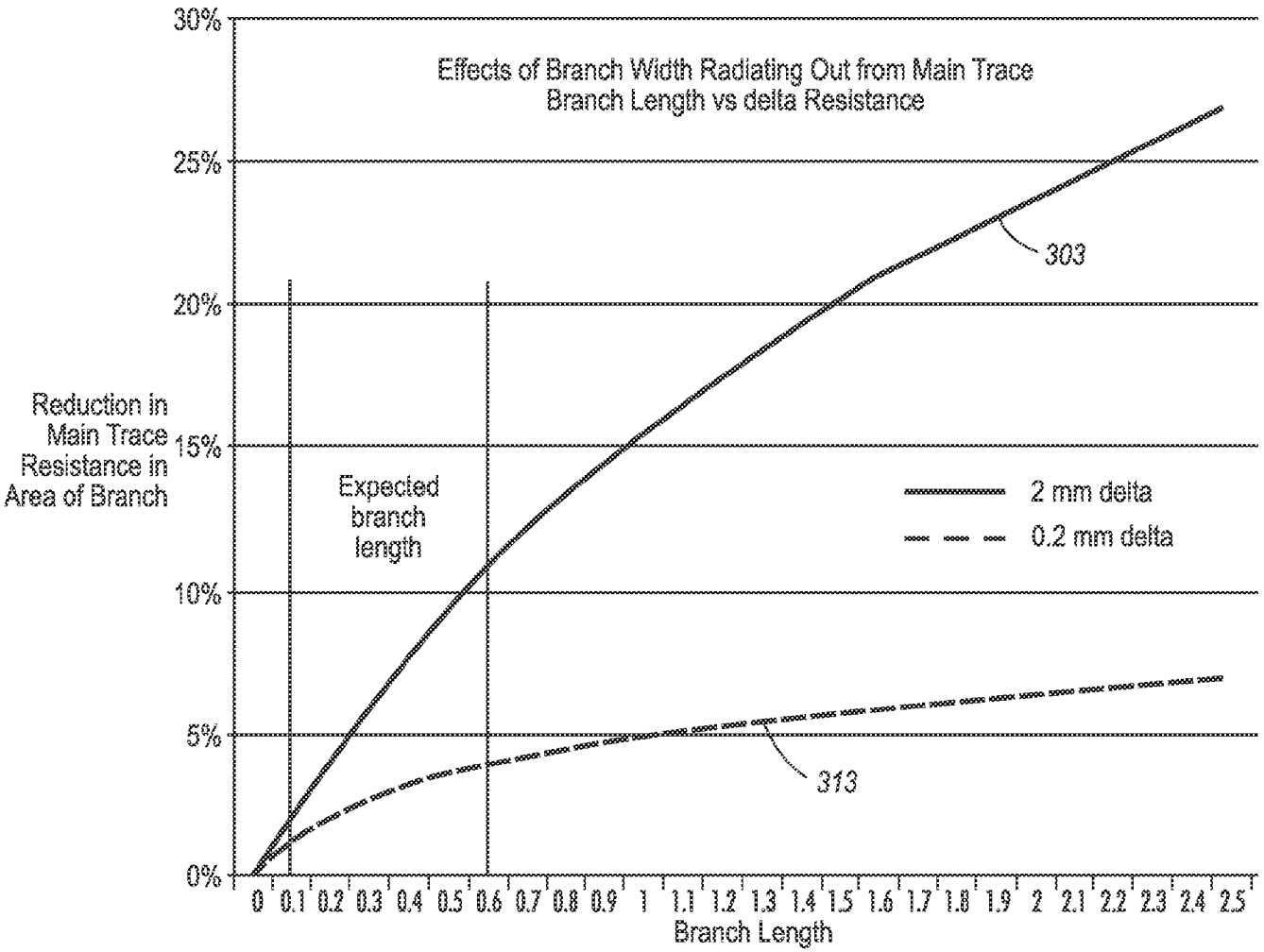
FIG. 3 is a graph showing the effect of branch width (2 mm vs. 0.2 mm) in relation to branch length on resistance in the main resistive trace, in the region of the contact point, according to devices and methods herein.

As shown in FIG. 2B, the design of the multi-branched tap 232 provides a relatively uniform thermal profile during bypass of the multi-branched tap 232. The graph in FIG. 3 shows the tap region profile change due to effects of resistive trace branch width and length with approximately 11% reduction in the thermal profile for the solid tap 209 shown in FIG. 2A (upper line 303) compared to approximately 3.5% reduction in the thermal profile for the multi-branched tap 232 shown in FIG. 2B (lower line 313). As the width of the tap 209 or the multi-branched tap 232 is reduced, its effect on the resistance of the main trace is minimized. Separation between the branches of the multi-branched tap 232 has no minimum value as long as there is no cross current flow between them—excluding joined interfaces.

The devices and methods described herein disclose a resistive tap design that prevents interference with the main resistive trace on a solid heater element. When using a tap on a long resistive trace, a cold spot is developed due to the reduced axial resistance in the trace because of the presence of the tap. According to devices and methods herein, a tap is attached to the main trace by a series/network of fine lines (branches). Therefore, the axial resistivity remains practically unchanged, thus preventing a cold spot from developing when the tap is not being used.

According to a machine herein, the machine comprises an imaging station 24 recording an image, a transfer station 32 transferring the image onto a copy sheet, and a fusing apparatus 16. The fusing apparatus 16 includes a fuser roll 27 and a pressure roll 29. The fuser roll 27 and pressure roll 29 form a nip therebetween through which the copy sheet is conveyed, permanently fusing the image onto the copy sheet. The fuser roll 27 includes a heater comprising a conductive trace 235 and a resistive trace 222. The resistive trace 222 has a multi-branched tap 232 connecting the resistive trace 222 to the conductive trace 235 and forms an electrical connection between the conductive trace 235 and the resistive trace 222. The multi-branched tap 232 comprises multiple branches extending out of the resistive trace 222. A gap is formed between each of the branches.

According to a printing device 10, an imaging station 24 records an image. A transfer station 32 transfers the image onto a copy sheet. The printing device 10 includes a fusing apparatus 16 comprising a fuser roll 27 and pressure roll 29. The fuser roll 27 and pressure roll 29 form a nip therebetween through which the copy sheet is conveyed, permanently fusing the image onto the copy sheet. The fuser roll 27 includes a heater comprising a single resistive trace 222 having a first end 225 and a second end 226. The single resistive trace 222 is contacted at multiple points by multiple conductive traces 228, 229, 235 segmenting the resistive trace into multiple segments. The multiple segments enable the single resistive trace 222 to heat copy sheets of different widths. The single resistive trace 222 further comprises a multi-branched tap 232 between the first end 225 and the second end 226 that forms an electrical connection between one of the multiple conductive traces (e.g., 235) and the single resistive trace 222. The multi-branched tap 232 comprises branches extending out of the single resistive trace 222. A gap is formed between each of the branches.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, the terms 'automated' or 'automatically' mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the systems and methods herein should not be implied or imported from any above example as limitations to any particular order, number, position, size, shape, angle, color, temperature, or material.

What is claimed is:

1. A fuser heater within a printing device, said heater comprising:

conductive traces; and a resistive trace having a first end and a second end, said resistive trace being connected to a first conductive trace at said first end and a second conductive trace at said second end and forming an electrical connection between said conductive traces and said resistive trace, said resistive trace further comprising a tap between said first end and said second end, said tap connecting said resistive trace to a third conductive trace at a point between said first end and said second end and forming an electrical connection between said third conductive trace and said resistive trace, said tap comprising a portion of said resistive trace having a cross section relatively larger than the remainder of said resistive trace by having multiple branches extending out of said resistive trace, a gap being formed between each of said branches, said third conductive trace being connected to said tap around said branches.

2. The fuser heater according to claim 1, said gap formed between each of said branches being approximately equal to the width of said branches.

3. The fuser heater according to claim 1, said third conductive trace overlapping the outer lateral boundaries of said tap by an amount equal to at least half the width of said branches.

4. The fuser heater according to claim 1, said resistive trace being located within a fuser roll, said fuser roll being located adjacent a pressure roll, and said fuser roll and said pressure roll forming a nip therebetween, said nip having an entrance side and an exit side, said resistive trace being positioned at a centerline of said nip with an offset towards said entrance side of said nip.

5. The fuser heater according to claim 1, said resistive trace comprising a single resistive trace.

6. The fuser heater according to claim 1, resistance of said resistive trace being relatively constant over the length of said resistive trace.

7. A machine, comprising:

an imaging apparatus recording an image;

a transfer device transferring said image onto a copy sheet; and a fuser comprising a fuser roll and a pressure roll, said fuser roll and pressure roll forming a nip therebetween through which said copy sheet is conveyed, fusing said image onto said copy sheet, said fuser roll including a heater comprising:

a conductive trace, and a resistive trace, said resistive trace having a tap connecting said resistive trace to said conductive trace and forming an electrical connection between said conductive trace and said resistive trace, said tap comprising a portion of said resistive trace having a cross section relatively larger than the remainder of said resistive trace by having multiple branches extending out of said resistive trace, a gap being formed between each of said branches, said conductive trace being connected to said tap around said branches.

8. The machine according to claim 7, said gap formed between each of said branches being approximately equal to the width of said branches.

9. The machine according to claim 7, said conductive trace overlapping the outer lateral boundaries of said tap by an amount equal to at least half the width of said branches.

10. The machine according to claim 7, said resistive trace being positioned at a centerline of said nip with an offset towards an entrance side of said nip.

11. The machine according to claim 7, said resistive trace comprising a single resistive trace.

12. The machine according to claim 7, further comprising:

multiple conductive traces, said resistive trace having a first end and a second end, said resistive trace being connected to a first conductive trace at said first end and a second conductive trace at said second end and forming an electrical connection between said first conductive trace and said second conductive trace through said resistive trace, said tap being located between said first end and said second end of said resistive trace.

13. The machine according to claim 7, resistance of said resistive trace being relatively constant over the length of said resistive trace.

14. A printer, comprising:

an imaging apparatus recording an image;

a transfer device transferring said image onto a copy sheet; and a fuser comprising a fuser roll and a pressure roll, said fuser roll and pressure roll forming a nip therebetween through which said copy sheet is conveyed, fusing said image onto said copy sheet, said fuser roll including a heater comprising a single resistive trace having a first end and a second end, said single resistive trace being contacted at multiple points by multiple conductive traces, said single resistive trace being connected to a first conductive trace at said first end and a second conductive trace at said second end and forming an electrical connection between said first conductive trace and said second conductive trace through said single resistive trace, said single resistive trace further comprising a tap between said first end and said second end, said tap connecting said single resistive trace to a third conductive trace at a point between said first end and said second end and forming an electrical connection between said third conductive trace and said single resistive trace, said tap comprising a portion of said single resistive trace having a cross section relatively larger than the remainder of said single resistive trace by having multiple branches extending out of said single resistive trace, a gap being formed between each of said branches, said third conductive trace being connected to said tap around said branches.

15. The printer according to claim 14, said gap formed between each of said branches being approximately equal to the width of said branches.

16. The printer according to claim 14, said third conductive trace overlapping the outer lateral boundaries of said tap by an amount equal to at least half the width of said branches.

17. The printer according to claim 14, said single resistive trace being positioned at a centerline of said nip with an offset towards an entrance side of said nip.

18. The printer according to claim 14, resistance of said single resistive trace being relatively constant over the length of said single resistive trace.

19. The printer according to claim 14, said multiple conductive traces segmenting said single resistive trace into multiple segments.

20. The printer according to claim 19, said multiple segments enabling heating copy sheets of different widths.

* * * * *